US007759641B2

(12) United States Patent
Hasegawa et al.

(10) Patent No.: US 7,759,641 B2
(45) Date of Patent: Jul. 20, 2010

(54) ION TRAP MASS SPECTROMETER

(75) Inventors: Hideki Hasegawa, Tachikawa (JP); Yuichiro Hashimoto, Tachikawa (JP); Izumi Waki, Tokyo (JP)

(73) Assignee: Hitachi, Ltd., Tokyo (JP)

( * ) Notice: Subject to any disclaimer, the term of this patent is extended or adjusted under 35 U.S.C. 154(b) by 155 days.

(21) Appl. No.: 11/653,859

(22) Filed: Jan. 17, 2007

(65) Prior Publication Data

US 2007/0181803 A1 Aug. 9, 2007

(30) Foreign Application Priority Data

Feb. 9, 2006 (JP) ..... 2006-031813

(51) Int. Cl.
*H01J 49/26* (2006.01)

(52) U.S. Cl. ..... 250/290; 250/281; 250/292

(58) Field of Classification Search ..... 250/281, 250/282, 287, 288, 290, 292, 293, 299, 286, 250/291, 294, 295, 296, 297; 95/57, 71, 95/72, 81; 96/54

See application file for complete search history.

(56) References Cited

U.S. PATENT DOCUMENTS

| | | | | |
|---|---|---|---|---|
| 2,939,952 | A | 6/1960 | Paul et al. | |
| 4,540,884 | A | 9/1985 | Stafford et al. | |
| 5,381,007 | A * | 1/1995 | Kelley | 250/282 |
| 5,420,425 | A | 5/1995 | Bier et al. | |
| 5,714,755 | A * | 2/1998 | Wells et al. | 250/281 |
| 5,783,824 | A * | 7/1998 | Baba et al. | 250/281 |
| 5,847,386 | A | 12/1998 | Thomson et al. | |
| 6,020,586 | A | 2/2000 | Dresch et al. | |
| 6,111,250 | A * | 8/2000 | Thomson et al. | 250/282 |
| 2003/0189171 | A1 * | 10/2003 | Londry et al. | 250/292 |
| 2005/0178963 | A1 * | 8/2005 | Londry et al. | 250/293 |
| 2009/0114810 | A1 * | 5/2009 | Green | 250/282 |

FOREIGN PATENT DOCUMENTS

JP 2005-44594 7/2003

* cited by examiner

*Primary Examiner*—Jack I Berman
*Assistant Examiner*—Nicole Ippolito Rausch
(74) *Attorney, Agent, or Firm*—Stites & Harbison PLLC; Juan Carlos A. Marquez, Esq.

(57) ABSTRACT

In a mass spectrometer in which a high ion dissociation efficiency is possible, inserted electrodes are arranged with a form divided into two or more in the axial direction of the ion trap, an electric static harmonic potential is formed from a DC voltage applied to the inserted electrodes, and with an Supplemental AC voltage applied, ions in the ion trap are oscillated between the divided inserted electrodes in the axial direction of the ion trap by resonance excitation, and the ion with a mass/charge ratio within a specific range is mass-selectively dissociated. Thus, a high ion dissociation efficiency is realized by the use of ion trap of the present invention.

5 Claims, 14 Drawing Sheets

ION TRAP MASS SPECTROMETER

CLAIM OF PRIORITY

The present application claims priority from Japanese application JP 2006-031813 filed on Feb. 9, 2006, the content of which is hereby incorporated by reference into this application.

FIELD OF THE INVENTION

The present invention relates to an ion trap mass spectrometer, and realizes a high ion dissociation efficiency with the use of an ion trap.

BACKGROUND OF THE INVENTION

When using a mass spectrometer for example, proteomics, the $MS^n$ analysis which performs mass analysis in a multi-stage mode becomes important.

As a mass spectrometry in which $MS^n$ analysis is possible, there is available a three-dimensional quadrupole ion trap mass spectrometer. In a three-dimensional quadrupole ion trap, ions with a specific mass/charge ratio (m/z) can be stably accumulated in the ion trap by applying RF voltage to the ion trap as disclosed in U.S. Pat. No. 2,939,952.

Furthermore, in the three-dimensional quadrupole ion trap, where ions are accumulated in the ion trap by scanning the voltage amplitude of the RF voltage, the ions in the ion trap become unstable in the order of their increasing m/z, and exit the trap in that order as disclosed in U.S. Pat. No. 4,540,884. Thus mass spectrometry becomes possible by detecting the order of the ejected ions.

Furthermore, in the three-dimensional quadrupole ion trap, a supplemental AC voltage is applied apart from the RF voltage, as disclosed in U.S. Pat. No. 4,736,101. Only those ions with the characteristic frequency for a specific m/z oscillate resonantly to the frequency of the supplemental AC voltage by resonance excitation are ejected from the ion trap and then detected, and mass analyzed, resulting in an enhanced resolution for mass spectrometry.

Furthermore, the technology disclosed in U.S. Pat. No. 4,736,101 enabled the $MS^n$ analysis to perform using the ion trap, which is important in proteomics. By resonance excitation caused by the supplemental AC voltage, ions accumulated in the ion trap are ejected from the trap except the ions with a specific m/z from the ion trap, and only specific ions are isolated in the ion trap. In the following process, the isolated ions are excited to oscillate by resonance excitation caused by the supplemental AC voltage, and made to collide with neutral gas filling the ion trap for multiple-times, resulting in dissociation of the isolated ions. Fragment ions generated by dissociation are ejected from the trap by scanning the voltage amplitude of the RF voltage in their order of m/z, and mass spectrometry is performed by detecting the order of ejection. By this technique, the more detailed structural information on sample molecules can be acquired from the decomposition state of fragment ions generated by dissociation.

Since a quadrupole linear ion trap disclosed in U.S. Pat. No. 5,420,425 enables a $MS^n$ analysis to perform as a three-dimensional quadrupole ion trap, and with higher ion accumulation efficiency than the three-dimensional quadrupole ion trap, this device realizes improvement in sensitivity. Furthermore, since there is little influence of the space charge resulting from the saturation of the accumulated ions in the ion trap, a resolution of mass analysis improves.

Moreover, by combining a quadrupole linear ion trap and a time-of-flight mass spectrometer, and by performing $MS^n$ analysis with the ion trap and mass analysis with the time-of-flight mass spectrometer, as disclosed in U.S. Pat. No. 6,020,586, a higher mass resolution and the $MS^n$ analysis of mass spectrometry are made possible.

In addition, as disclosed in JP-A No. 044594/2005, by providing a collision dumping chamber due to a neutral gas between the quadrupole linear ion trap and the time-of-flight mass spectrometer, the energy and the position of ions ejected from the ion trap are converged, improving ion introduction efficiency into the acceleration region of time-of-flight mass spectrometer, and a high sensibility analysis can be realized.

The U.S. Pat. No. 5,783,824 discloses a system wherein by applying a direct current (DC) voltage to the electrodes inserted between rod electrodes of the quadrupole linear ion trap, an electrostatic harmonic potential is formed in the axial direction of the trap to accumulate ions. Furthermore, if the electrostatic harmonic potential is formed in the axial direction, and by applying the supplemental AC voltage to the inserted electrodes, ions can be ejected in the axial direction mass-selectively via resonance excitation. Mass spectrometry becomes available by detecting the ejected ions.

U.S. Pat. No. 5,847,386 discloses a system that controls the time to pass a quadrupole electrode for ions by arranging an electrode between each rod electrode of a quadrupole electrode, and forms an electric field in an axial direction. Furthermore, improvement in dissociation efficiency of ions is attempted by varying the electric field in the axial direction, and ions go and come back along the axis and then collide with a neutral gas molecule in the quadrupole electrode.

SUMMARY OF THE INVENTION

Using an ion trap system, such as a three-dimensional quadrupole ion trap and a quadrupole linear ion trap, as disclosed in the U.S. Pat. No. 2,939,952, U.S. Pat. No. 4,540,884, U.S. Pat. No. 4,736,101, U.S. Pat. No. 5,420,425, U.S. Pat. No. 6,020,586, and JP-A No. 044594/2005, the ions accumulated and stored in the ion trap are made to dissociate by the collision with neutral gas molecules, and a fine structure is determined from the fragment ions generated from the collisions. The ion dissociation in the ion trap is performed such that while a RF voltage is applied to electrodes, a supplemental AC voltage is also imposed at the electrodes to excite and oscillate ions by resonance excitation. However, under general RF voltage conditions, since fragment ions generated by dissociation having ¼ or less m/z compared with that of sample ions are ejected out of the ion trap in early stage, such ions are unable to be detected although dissociation.

FIG. 1 shows a mass spectrum of bivalent ions of Glu-fibrinopeptide B dissociated using a spectrometer with the same structure as disclosed in JP-A No. 044594/2005. The horizontal axis of FIG. 1 represents the m/z, and the vertical axis represents the relative ion intensity. It can be confirmed that the ions of ¼ or less m/z (about 200 or less m/z) are not to observed, in contrast to the sample ions dissociated (m/z 785.8). In addition, only y2-y11 are shown in FIG. 1, which are the typical fragment ions generated by dissociation from Glu-fibrinopeptide B.

The reason why the fragment ions with low mass generated by dissociation cannot be detected is because the ions with lower mass are eliminated by the RF voltage (low mass cut-off). Although the low mass cut-off can be shifted to the lower mass side by making the RF voltage low, since the trap potential in the radial direction formed by the RF voltage becomes shallow, lighter ions becomes more easily eliminated before the sample ions dissociates by resonance excitation oscillation, and the dissociation efficiency falls down sharply.

The U.S. Pat. No. 5,783,824 is a system which performs accumulation and ejection of ions by the electrostatic harmonic potential formed in the axial direction of the quadrupole linear ion trap. However, since isolation and dissociation of ions are not performed within a quadrupole linear ion trap, $MS^n$ analysis is unable to be performed.

In the system of U.S. Pat. No. 5,847,386, if the low mass cutoff is set to a low value, since ions are made to go back and forth in the axial direction, they are hardly affected by the potential variation in the radial direction, so that fragment ions with low mass can be detected. However, since all the ions in the quadrupole electrodes are made to go back and forth and to dissociate, the fragment ions generated by dissociation may possibly dissociate themselves (secondary dissociation). That is, by this system, ions cannot be dissociated mass-selectively. Moreover, since the isolation method for the ions is not described, $MS^n$ analysis cannot be applied to the system.

In the mass spectrometer using a linear ion trap, it is important to enable detection of the low mass fragment ions generated by dissociation.

The mass spectrometer of the present invention is characterized in that the spectrometer comprises an ion source for generating ions, an ion trap for accumulating, isolating, dissociating, and ejecting ions, electric field forming electrodes for forming electric field in the axial direction of the ion trap, wherein the electric field is formed from an electrostatic potential, a power supply unit for controlling, operation of the ion trap, and a detector for detecting ions ejected from the ion trap, the power supply including an supplemental AC power supply which applies an supplemental AC voltage to the electric field forming electrodes, and with the supplemental AC voltage applied to the electric field forming electrodes, the ions in the ion trap are oscillated in the axial direction of the ion trap by resonance excitation, and the ions within specific m/z range are mass-selectively dissociated.

In the mass spectrometer of the present invention, the electrodes, having a form divided into two or more, are inserted and arranged in the axial direction of the ion trap, and the electrostatic harmonic potential is formed with a DC applied to the inserted electrodes. Ions are oscillated in the axial direction through resonance excitation caused by the supplemental AC voltage applied between the divided and inserted electrodes, and the ions with a m/z within a specific range are mass-selectively dissociated.

By the use of the ion trap of the present invention, it becomes possible to detect dissociated low mass fragment ions generated.

DETAILED DESCRIPTION OF THE PREFERRED EMBODIMENTS

First Embodiment

In the first embodiment, the system is described in which sample ions for dissociation are resonance excited and oscillated in the axial direction by the supplemental AC voltage, and are dissociated due to collision with neutral gas molecules in the linear ion trap having multipole electrodes.

Figure 2:
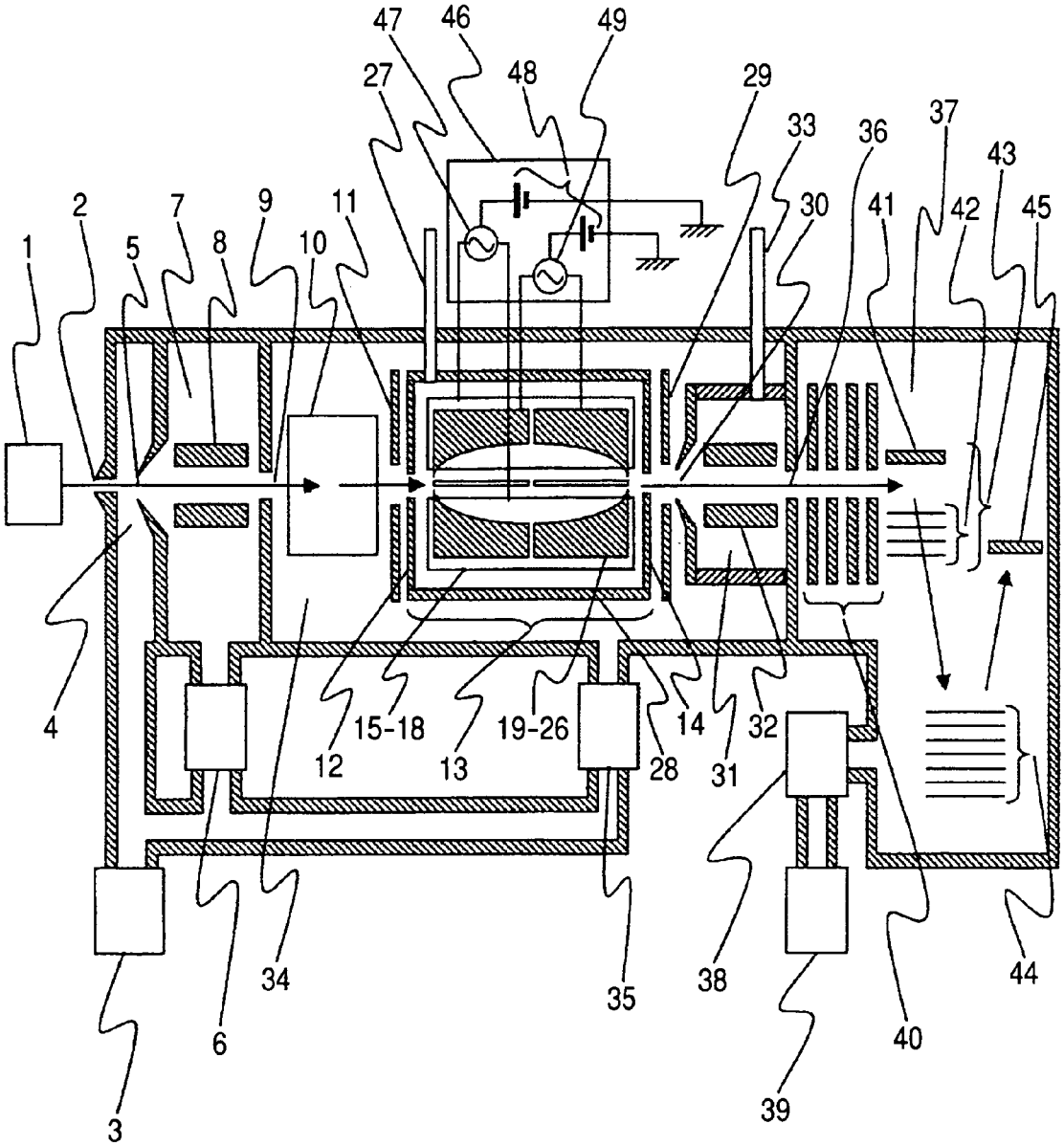
FIG. 2 is a schematic sectional view of the spectrometer used in the first embodiment of the present invention.

FIG. 2 shows a schematic composition of the quadrupole linear ion trap time-of-flight mass spectrometer in accordance with the present invention.

The ions generated in an ion source 1 pass through aperture 2, and are introduced into a first differential pumping region 4 evacuated to 100-500 Pa with a rotary pump 3. Then, ions pass through aperture 5 and are introduced into a second differential pumping region 7 evacuated with a turbo molecular pump 6. The second differential pumping region 7, in which multipole electrodes 8 are arranged, is maintained at pressure of about 0.3-3 Pa. A radiofrequency wave with a frequency of about 1 MHz, and a voltage amplitude of several hundred volts, is applied to multipole electrodes 8 with a phase alternately reversed. Ions are converged in the vicinity of the central axis of the multipole electrodes 8 and transported with high efficiency.

The ions converged with the multipole electrodes 8 pass through the aperture 9, and are introduced into an ion isolation unit 10 for dissociation. The ion isolation unit 10 for dissociation isolates only the ions for which detailed analysis is to be performed by dissociation from among the ions generated in the ion source 1, and the analysis is performed using an ion trap system, a multipole mass filter, or the like.

The ions isolated in the ion isolation unit 10 as sample ions for dissociation pass through the hole of a gate electrode 11 and an incap electrode 12, and are introduced into a quadrupole linear ion trap 13. The quadrupole linear ion trap 13 is constituted by an incap electrode 12, an endcap electrode 14, four rod electrodes 15-18, and eight sheets of inserted electrodes 19-26 divided in the axial direction. Neutral gas, such as helium, is introduced into the quadrupole linear ion trap 13 through a piping 27. The quadrupole linear ion trap 13 is constituted inside a case 28, and is held at pressures of about 0.01-1 Pa. In the quadrupole linear ion trap 13, accumulation and dissociation of the sample ions are performed, and then the ions are ejected out of the quadrupole linear ion trap 13 through the hole at the endcap electrode 14.

The removed ions pass through an ion stop electrode 29 and aperture 30, and are introduced into a collision dumping chamber 31. A multipole electrode 32 is arranged in the collision dumping chamber 31, and neutral gas, such as helium, is introduced through a piping 33, and maintains a pressure of about 10 Pa. A radiofrequency of about 2 MHz with a voltage amplitude of about 1 kV is applied to the multipole electrodes 32 with an alternating phase. In the collision dumping chamber 31, the ions lose their kinetic energy by the collision with a neutral gas molecule, and are converged. The ion isolation unit 10, the quadrupole linear ion trap 13, and the collision dumping chamber 31 are arranged inside the vacuum chamber 34, which is evacuated with a turbo molecular pump 35 and is maintained to a vacuum pressure of about $1\times10^{-3}$ Pa. The exhausted gases of the turbo molecular pump 6 and the turbo molecular pump 35 are exhausted with the rotary pump 3.

The ions converged in the collision dumping chamber 31 pass aperture 36, and are introduced into a TOF chamber 37. The TOF chamber 37 is evacuated with a turbo molecular pump 38, and is held at a pressure of about $2\times10^{-4}$ Pa. The exhausted gas from the turbo molecular pump 38 is exhausted with a rotary pump 39. The ions pass through a lens electrode 40 constituted from an electrode of two or more sheets, and reach an acceleration unit 43 which consists of a push electrode 41 and pull electrodes 42. To the push electrode 41, an acceleration voltage is applied with frequencies of about 1-10 kHz, and the ions are accelerated to the direction orthogonal to the axial direction. The accelerated ions are reflected by a reflectron 44, and reach a detector 45 and are detected. Since ions differ in flight time with mass, a mass spectrum is obtained from flight time and signal strength.

Figure 3A:
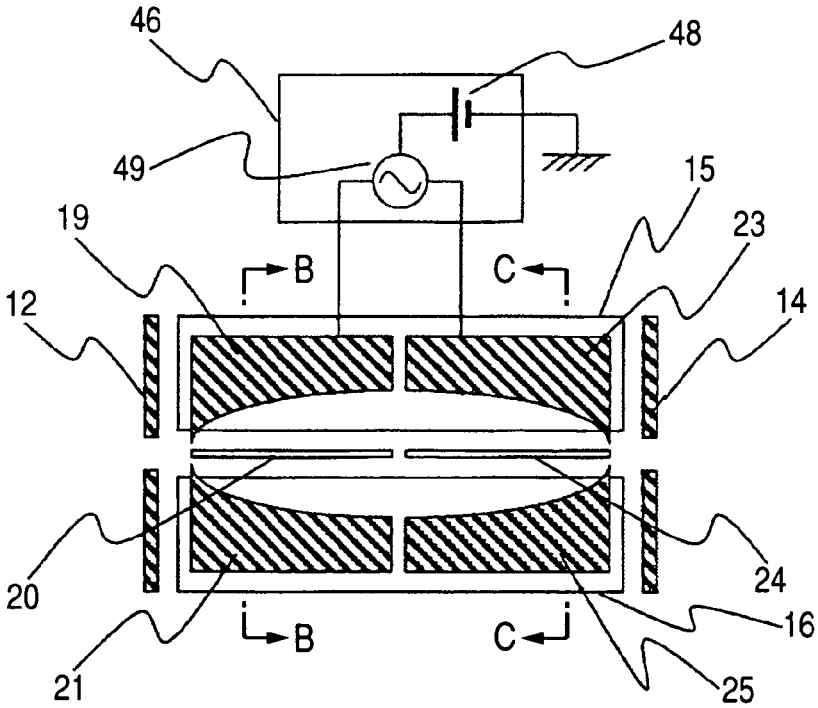
FIG. 3A is a block diagram of the power supply connected to the inserted electrodes in longitudinal section of the spectrometer used in FIG. 2.
Figure 3B:
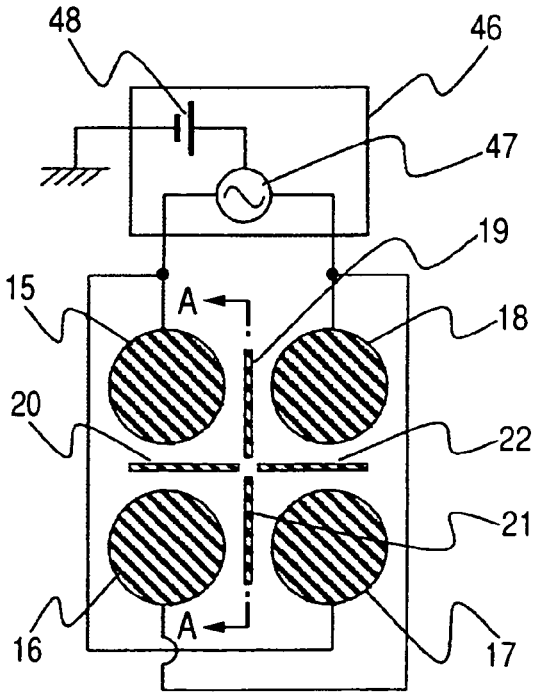
FIG. 3B is a block diagram of the power supply connected to the rod electrodes in transverse section at B-B of the spectrometer used in FIG. 2.
Figure 3C:
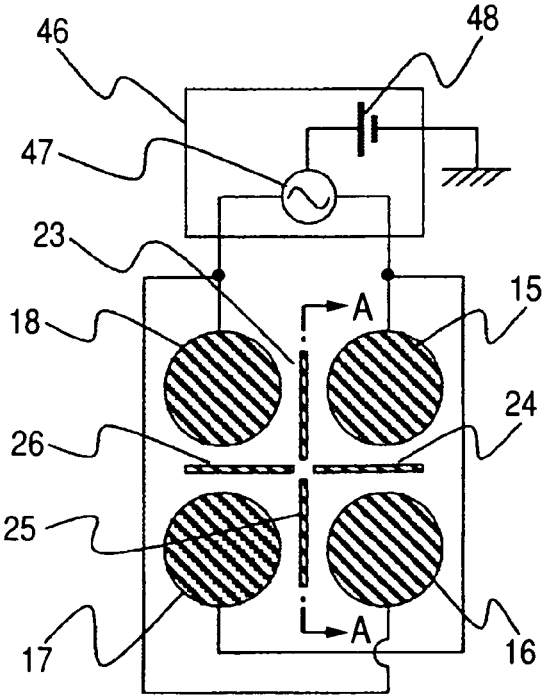
FIG. 3C is a block diagram of the power supply connected to the rod electrodes in transverse section at C-C of the spectrometer used in FIG. 2.

Next, the voltage application method to the quadrupole linear ion trap 13 is explained. A detailed diagram is shown in FIG. 3. A power supply unit 46 comprises an RF generator 47, a DC power supply 48, and a supplemental AC power supply 49. The RF generator 47 applies a RF voltage with a frequency of about 800 kHz, and a voltage amplitude of about 5 kV, between the rod electrodes 15 and 17 and the rod electrodes 16 and 18. The DC power supply 48 applies about 10-20V offset voltage to the whole rod electrodes 15-18, applies the voltage of about a maximum of 50 v both to the incap electrode 12 and the endcap electrode 14, and applies the offset voltage of about a maximum of 50 v to the inserted electrode 19-26. A supplemental AC power supply 49 applies a RF voltage with a frequency of a maximum of about 100 kHz and a voltage amplitude of 10V between the inserted electrode 19-22 and the inserted electrode 23-26.

Figure 4:
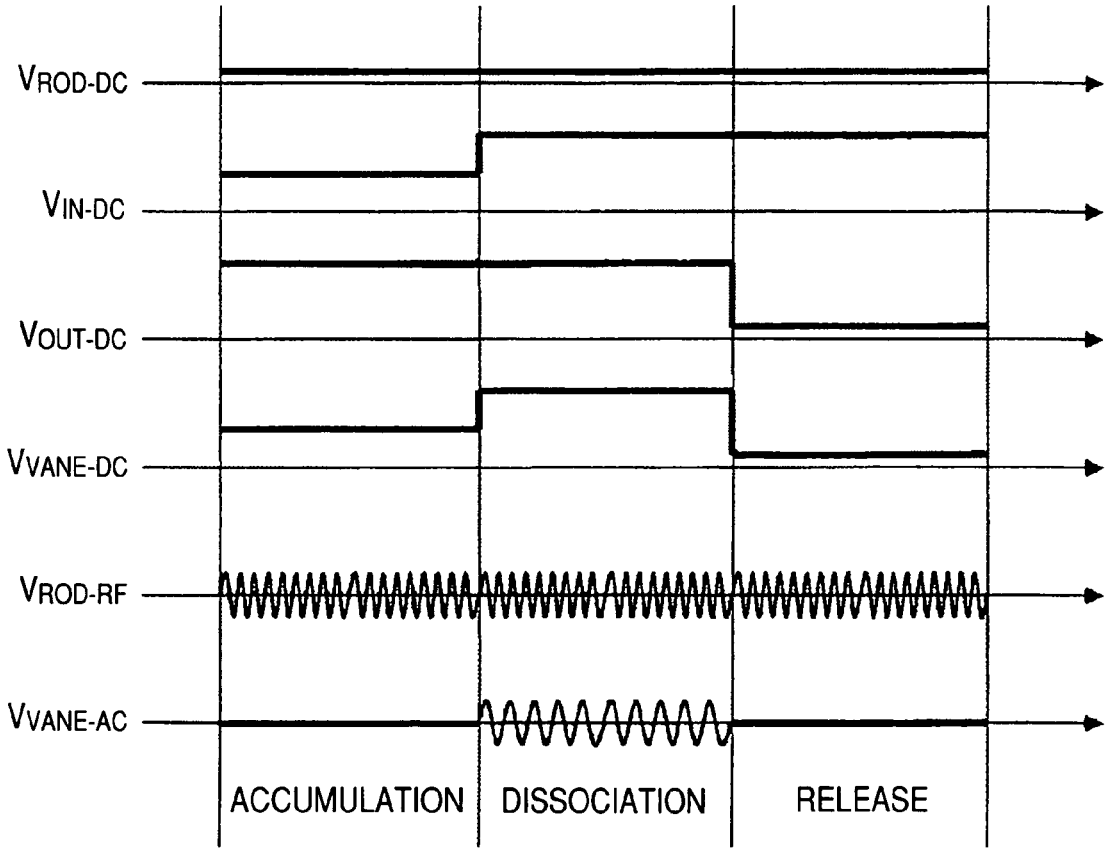
FIG. 4 is the operating sequence of the voltages applied to the electrodes shown in FIGS. 3A-3C for ion dissociation.

Next, referring to FIG. 4, the operating sequence of each electrode is explained in the case of performing ion dissociation with the quadrupole linear ion trap 13. The operating-sequence diagram shown in FIG. 4 includes an accumulation process and a dissociation process of the sample ions for dissociation, and an ion ejection process after the dissociation process.

In the accumulation process of sample ions for dissociation, the offset voltage ($V_{ROD\text{-}DC}$) of 10-20V is applied to the whole rod electrodes 15-18, a voltage of a maximum 10 V ($V_{IN\text{-}DC}$) higher than that of $V_{ROD\text{-}DC}$ is applied to the incap electrode 12, a voltage of a maximum 30 V ($V_{OUT\text{-}DC}$) higher than that of $V_{ROD\text{-}DC}$ is applied to the endcap electrode 14, and an offset voltage of a maximum 30 V ($V_{VAN\text{-}DC}$) higher than at $V_{ROD\text{-}DC}$ is applied to the inserted electrodes 19-26, although an RF voltage ($V_{ROD\text{-}RF}$) is applied between the rod electrodes 15 and 17 and the rod electrodes 16 and 18 at this time, and a supplemental AC voltage ($V_{VANE\text{-}AC}$) is not applied between the inserted electrodes 19-22 and the inserted electrodes 23-26. The sample ions for dissociation are accumulated in a stable state in the quadrupole linear ion trap 13 by this operation.

In the dissociation process of sample ions for dissociation, $V_{ROD\text{-}DC}$ is set to 10-20V, and $V_{IN\text{-}DC}$ and $V_{OUT\text{-}DC}$ are set to higher voltage than $V_{ROD\text{-}DC}$ by maximum of about 30 V, and $V_{VANE\text{-}DC}$ set to equal to or higher than $V_{ROD\text{-}DC}$ voltage by 5 V or more. At this time, $V_{ROD\text{-}RF}$ is applied and $V_{VANE\text{-}AC}$ whose voltage amplitude value is about maximum 10V is applied. By these operations, the ions (sample ions for dissociation) with the m/z corresponding to the frequency of $V_{VANE\text{-}AC}$ are excited and oscillated resonantly, and thus mass-selectively, in the axial direction, and collide with neutral gas molecules to dissociate in the quadrupole linear ion trap 13.

At the ion ejection process after the dissociation operation, $V_{ROD\text{-}DC}$ is set to 10-20V. $V_{IN\text{-}DC}$ is set to a voltage higher than that of $V_{ROD\text{-}DC}$ by about a maximum of 30 V, $V_{OUT\text{-}DC}$ is set to a voltage lower than that of $V_{ROD\text{-}DC}$ by about a maximum of 5 V, and $V_{VANE\text{-}DC}$ is set to a voltage nearly equal to that of $V_{ROD\text{-}DC}$. At this time, $V_{ROD\text{-}RF}$ is applied and $V_{VANE\text{-}AC}$ is not applied. The fragment ions generated from the dissociation are ejected from the quadrupole linear ion trap 13 by these operations.

The ions ejected from the quadrupole linear ion trap 13 pass the ion stop electrode 29, and mass spectrometry is performed by the method explained in the TOF chamber 37 as shown in FIG. 2.

Figure 1:
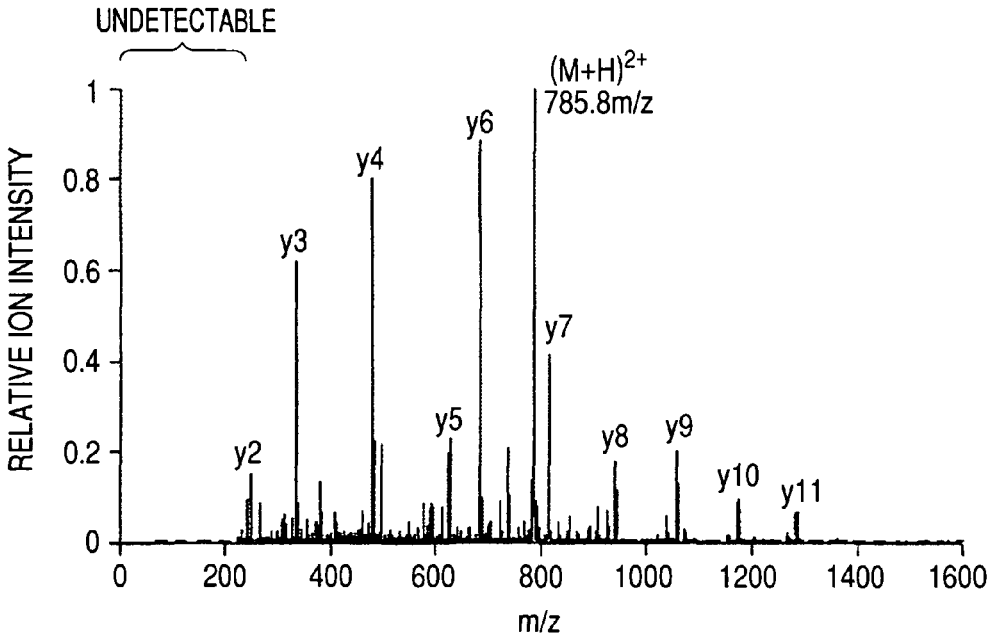
FIG. 1 is a graphical representation of an example to show a problem with a prior art.
Figure 5:
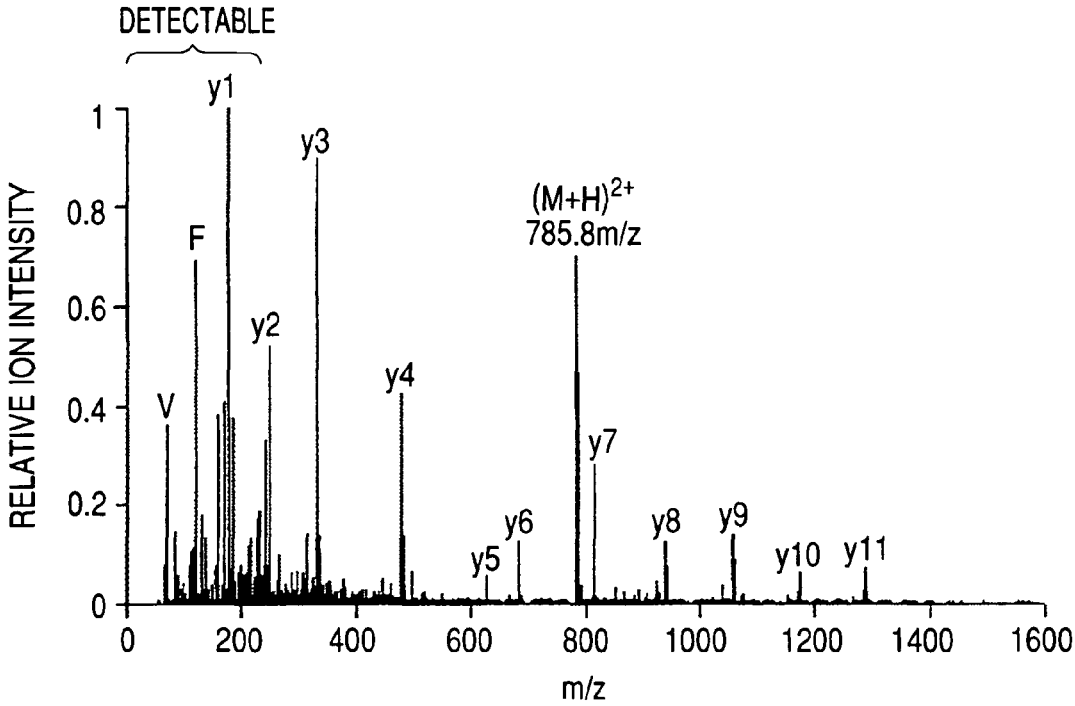
FIG. 5 is an example of mass spectrum obtained with a system and procedure of FIGS. 2-4 for the same ions in FIG. 1.

Next, the mass spectrum obtained by the structure and the system, which were shown in FIGS. 2 to 4 when 2 value ions of Glu-fibrinopeptide B are dissociated, is shown in FIG. 5. The horizontal axis of FIG. 5 represents mass/charge ratios (m/z) and the vertical axis relative ionic intensities. Fragment ions generated from the dissociation with about 200 or less m/z ratios, which were not able to be detected in FIG. 1 and were common with a conventional system, are now clearly detected and confirmed in the result of FIG. 5. Typical dissociation generation fragment ions, such as y1 (m/z 173.1), F (m/z 120.1), and V (m/z 72.1), can also be detected in FIG. 5 in addition to the dissociation generation fragment ions of y2-y11 which were obtained in FIG. 1.

Figure 6:
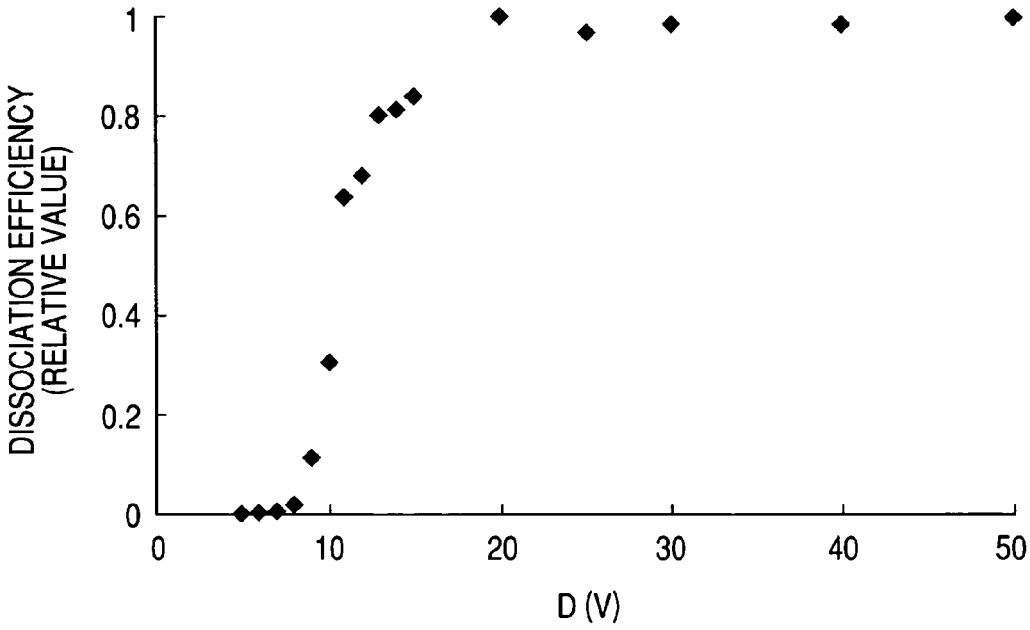
FIG. 6 shows the variation of dissociation efficiency for a TBA (m/z 242) as a function of static harmonic potential depth D.

Next, in the structure and the system which were shown in FIGS. 2 to 4, the variation of dissociation efficiency is shown against the variation of electrostatic harmonic potential depth (D) in FIG. 6 by using one value ions (m/z 242) of TBA as the sample ions for dissociation. The D value is almost equivalent to the potential difference between $V_{ROD-DC}$ and $V_{VANE-DC}$. The horizontal axis of FIG. 6 represents D ($=V_{VANE-DC}-V_{ROD-DC}$) when $V_{ROD-DC}$ is fixed to 15V, and only $V_{VANE-DC}$ is changed. The vertical axis of FIG. 6 represents the relative value of dissociation efficiency (=the amount of dissociation generation fragment ions/decrement of the sample ions for dissociation). From FIG. 6 it can be confirmed that it is necessary to set the D value equal to or larger than 5V in order to make the sample ions resonantly excited and oscillated with a supplemental AC voltage, and collide with a neutral gas molecule to dissociate in the quadrupole linear ion trap 13 of the present system.

Second Embodiment

The second embodiment explains a system in which, in the linear ion trap with a multipole electrode, sample ions for dissociation are isolated, resonantly excited and oscillated in the axial direction with a supplemental AC voltage, and then collided with neutral gas and dissociated in the structure of quadrupole linear ion trap time-of-flight mass spectrometer.

In the embodiment, a system is explained in which ions are resonantly excited, and oscillated with a supplemental AC voltage, and all the ions except the sample ions for dissociation are ejected out of a linear ion trap, and then the sample ions are dissociated.

Figure 7A:
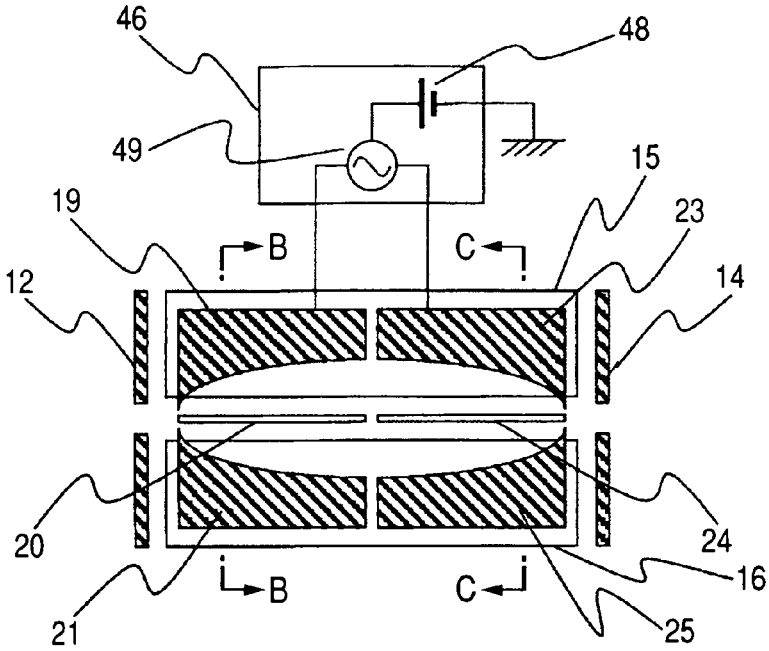
FIG. 7A is a block diagram of the power supply connected to the inserted electrodes in longitudinal section of the spectrometer used in FIG. 2.
Figure 7B:
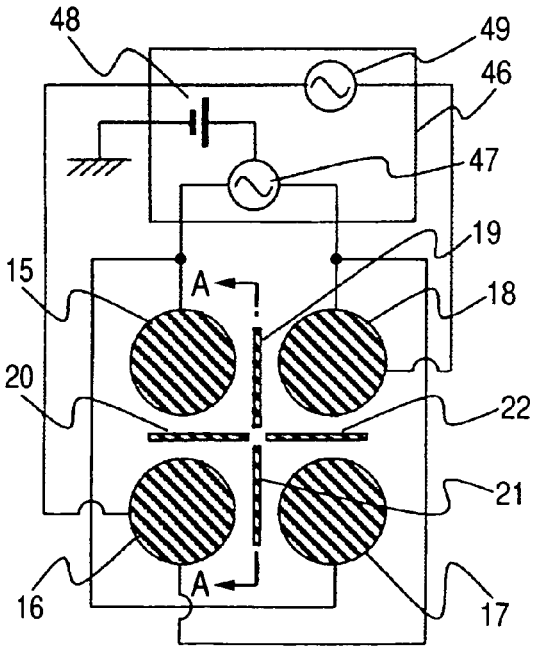
FIG. 7B is a block diagram of the power supply connected to the rod electrodes in transverse section at B-B of the spectrometer used in FIG. 2.
Figure 7C:
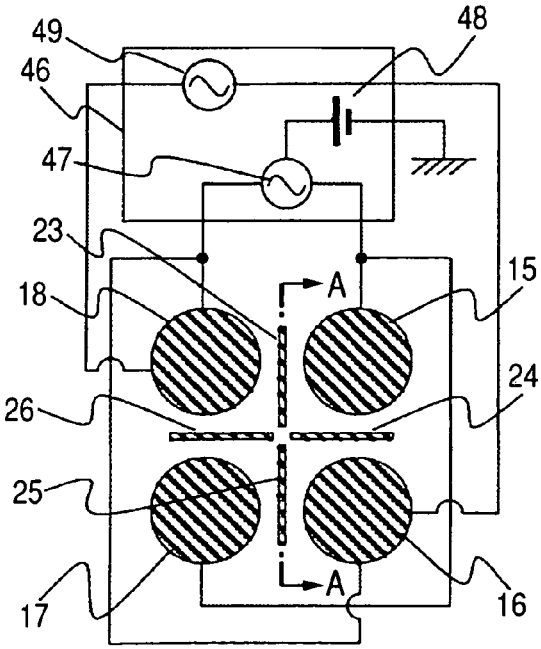
FIG. 7C is a block diagram of the power supply connected to the rod electrodes in transverse section at C-C of the spectrometer used in FIG. 2. The above system is used in the second embodiment and similar to that shown in FIGS. 3A-3C except that the sample ions can be isolated in the quadrupole linear ion trap 13 (not shown)

Although the configuration of spectrometer in the present embodiment is nearly the same as that shown in FIG. 2, the sample ion isolation unit 10 is not necessarily required, since the sample ions for dissociation can be isolated in the quadrupole linear ion trap 13. Since the voltage application methods are different from those in the first embodiment, the methods are explained in detail below using FIG. 7. The power supply unit 46 comprises an RF generator 47, a DC power supply 48, and a supplemental AC power supply 49. The RF generator 47 applies the RF voltage with a frequency of about 800 kHz, and a voltage amplitude of about 5 kV between the rod electrodes 15 and 17 and the rod electrodes 16 and 18. The DC power supply 48 applies an offset voltage of about 10-20 V to the whole rod electrodes 15-18, a voltage of about a maximum of 50 V to an incap electrode 12 and an endcap electrode 14, and an offset voltage of about a maximum of 50 V to the inserted electrodes 19-26. Supplemental AC power supply 49 applies a supplemental, AC voltage with a frequency of about 5-350 kHz, and with a voltage about 35 V, between the rod electrode 16 and the rod electrode 18, and a RF voltage with the frequency of a maximum of about 100 kHz, and a voltage of about 10 V, between the inserted electrode 19-22 and the inserted electrode 23-26.

Figure 8:
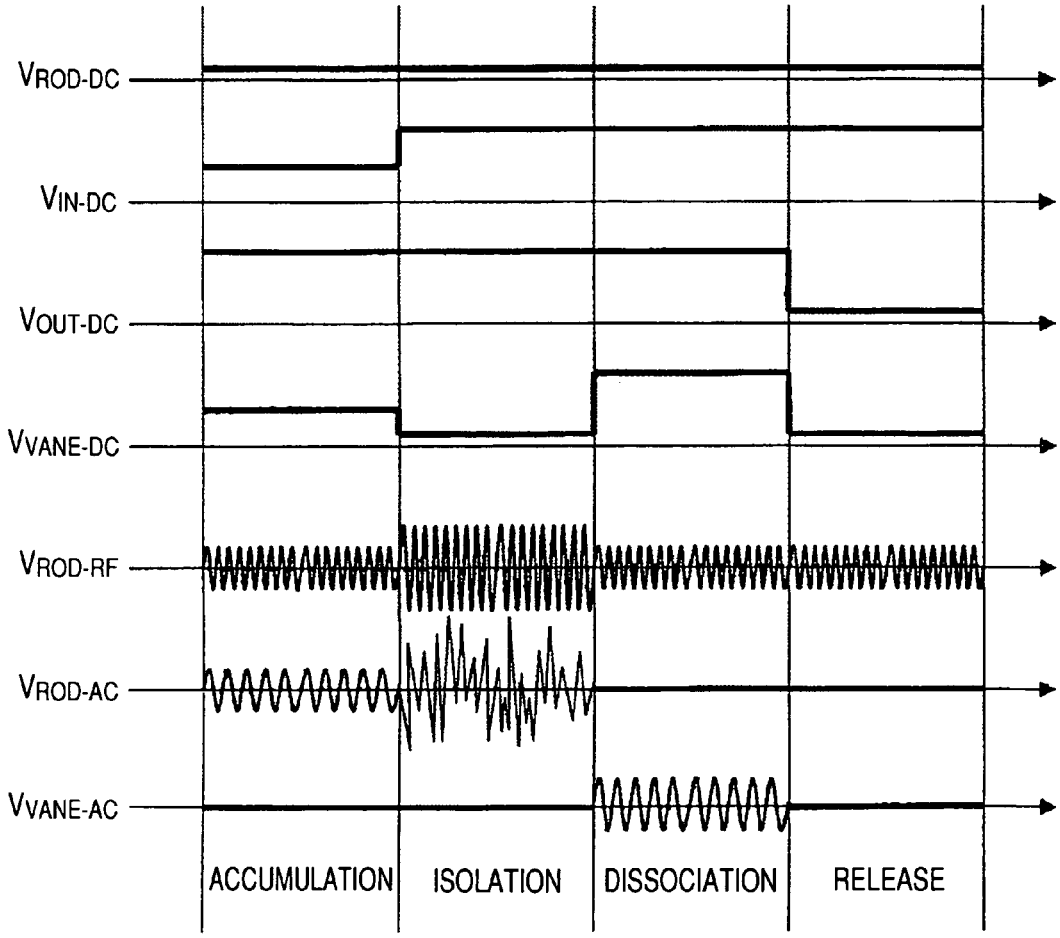
FIG. 8 is the operating sequence of the voltages applied to the electrodes shown in FIGS. 7A-7C for ion dissociation in the second embodiment.

Next, the operating sequence of each electrode in the case of performing isolation and dissociation of the ions for dissociation by the quadrupole linear ion trap 13 using FIG. 8 is explained. The operating-sequence diagram of FIG. 8 consists of an accumulation process and an isolation process for the sample ions for dissociation, a dissociation process, and an ion ejection process after the dissociation operation.

In the accumulation process of the sample ions for dissociation, an offset voltage ($V_{ROD-DC}$) of 10-20 V is applied to the whole rod electrode 15-18, a voltage ($V_{IN-DC}$) of a maximum 10 V higher than that of $V_{ROD-DC}$ is applied to the incap electrode 12, a voltage ($V_{OUT-DC}$) of a maximum 30 V higher than that of $V_{ROD-DC}$ is applied to the endcap electrode 12, and an offset voltage ($V_{VANE-DC}$) of a maximum 20 V higher than that of $V_{ROD-DC}$ is applied to the inserted electrodes 19-26. At this time, a RF voltage ($V_{ROD-RF}$) is applied between the rod electrodes 15 and 17 and the rod electrodes 16 and 18. A supplemental AC voltage ($V_{ROD-AC}$) is not necessarily applied between the rod electrode 16 and the rod electrode 18. A supplemental AC voltage ($V_{VANE-AC}$) is not applied between the inserted electrode 19-22 and the inserted electrode 23-26. All the ions generated in the ion source 1 are accumulated stably in the quadrupole linear ion trap 13 by these operations.

In the isolation process of the sample ions for dissociation, $V_{ROD-DC}$ is set to 10-20V, and $V_{IN-DC}$ and $V_{OUT-DC}$ are set to a voltage of a maximum 30 V higher than that of $V_{ROD-DC}$ and $V_{VANE-DC}$ is set to the same voltage as that of $V_{ROD-DC}$. At this time, $V_{ROD-RF}$ and $V_{ROD-AC}$ are applied, and $V_{VANE-AC}$ is not applied. One of the methods for applying $V_{ROD-AC}$ at this time is to use a combined wave with a shape of a noch (FNF) in which only the frequency corresponding to the m/z range of the ions for dissociation does not exist, or to use scanning the frequency of $V_{ROD-AC}$ from higher frequencies to lower frequencies (or the opposite direction), etc. In the latter case, it is necessary to exclude only the frequencies corresponding to the m/z range of the ions for dissociation in the scanning process. In both methods the ions with m/z other than that of the ions for dissociation execute resonance excitation oscillation, and are removed out of the quadrupole linear ion trap 13. By these operations, since only the ions for dissociation do not perform resonance excitation oscillation, it can be isolated in the quadrupole linear ion trap 13 in a stable state.

In the dissociation process of the sample ions for dissociation, $V_{ROD-DC}$ is set to 10-20V, and $V_{IN-DC}$ and $V_{OUT-DC}$ are set to a voltage of a maximum 30 V higher than that of $V_{ROD-DC}$ and $V_{VANE-DC}$ is set to a voltage of 5 V higher than or equal to that of $V_{ROD-DC}$. At this time, $V_{ROD-RF}$ is applied and $V_{ROD-AC}$ is not applied. Furthermore, $V_{VANE-AC}$ with a voltage of about maximum 10V is applied. By these operations only the ions (sample ions for dissociation) with the m/z corresponding to the frequency of $V_{VANE-AC}$ are resonantly excited mass-selectively in the axial direction, and collide with the neutral gas in the quadrupole linear ion trap 13, and dissociate.

In the ion ejection process after dissociation, $V_{ROD-DC}$ is set to 10-20V, and $V_{IN-DC}$ is set to a voltage of a maximum 30 V higher than that of $V_{ROD-DC}$ and $V_{OUT-DC}$ is set to a voltage of a maximum 5 V lower than that of $V_{ROD-DC}$ and $V_{VANE-DC}$ is set to a voltage comparable as $V_{ROD-DC}$. At this time, $V_{ROD-RF}$ is applied and $V_{ROD-AC}$ and $V_{VANE-AC}$ are not applied. By these operations, the fragment ions dissociated and generated are ejected from the quadrupole linear ion trap 13.

By repeating the operation of FIG. 8, in the quadrupole linear ion trap 13, new ions for dissociation can be isolated from dissociated and generated fragment ions, and can be dissociated further. That is, $MS^n$ analysis ($n \geqq 3$) can be performed.

The ions ejected from the quadrupole linear ion trap 13 pass through the ion stop electrode 29, and mass spectrometry is performed in the TOF chamber 37 by the method explained in FIG. 2.

Third Embodiment

The third embodiment shows a system in which, in the structure of quadrupole linear ion trap time-of-flight mass spectrometer, ions are resonantly excited and oscillated in the axial direction with a supplemental AC voltage, so that all the ions except the one for dissociation are ejected out of the linear ion trap, and then the ions for dissociation are made to dissociate.

Although the configuration of spectrometer in the present embodiment is nearly the same as that shown in FIG. 2, a sample ion isolation unit 10 is not necessarily required since the sample ions for dissociation can be isolated in the quadrupole linear ion trap 13. Although the voltage applying method is nearly the same as that shown in FIG. 3, since the operating sequence is different from those in the embodiment 1 and 2, the sequence is explained in detail in the following.

Figure 9:
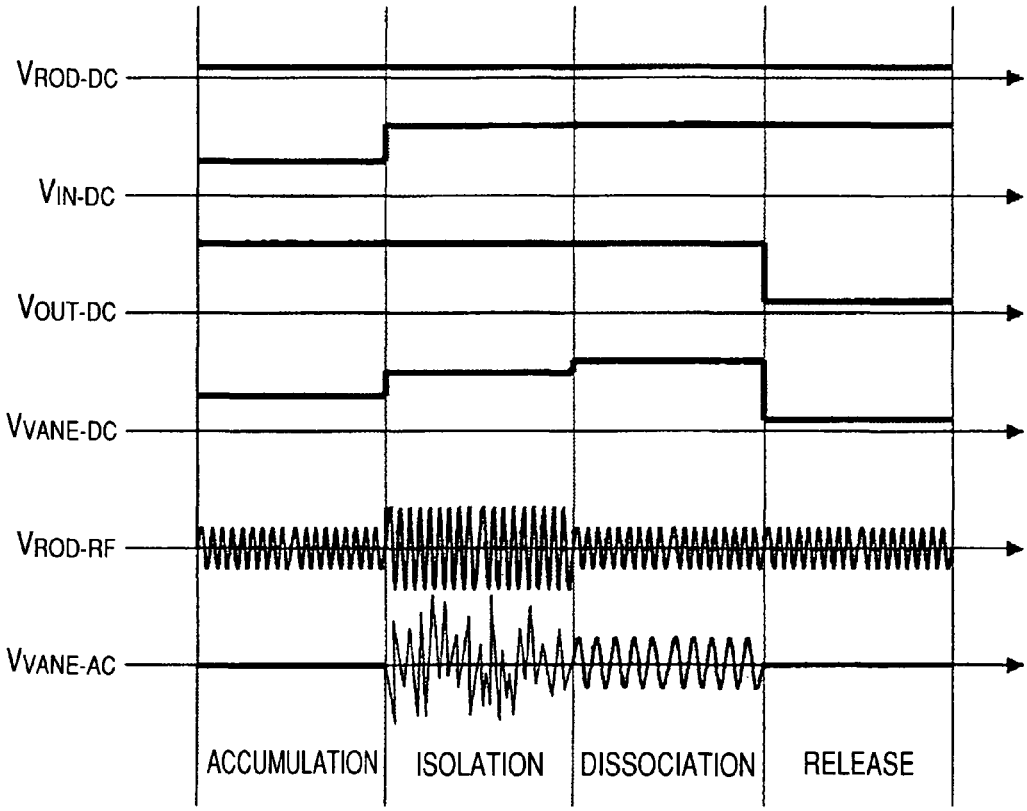
FIG. 9 is the operating sequence of the voltages applied to the electrodes shown in FIGS. 7A-7C for ion dissociation in the third embodiment.

Referring to FIG. 9 the operating sequence is explained of each electrode in the case of performing isolation and dissociation of the ions for dissociation by using the quadrupole linear ion trap 13. The operating-sequence of FIG. 9 consists of an ion accumulation process, an isolation process of the ions for dissociation, an ion dissociation process, and an ion ejection process after dissociation operation. Since the operating sequence of accumulation, dissociation, and ejection processes is the same as that of FIG. 4, only the isolation process is explained in the following.

In the isolation process of the sample ions for dissociation, $V_{ROD\text{-}DC}$ is set to 10-20V, and $V_{IN\text{-}DC}$ and $V_{OUT\text{-}DC}$ are set to a voltage of a maximum 30 V higher than that of $V_{ROD\text{-}DC}$ and $V_{VANE\text{-}DC}$ is set to a voltage of a maximum 30 V higher than that of $V_{ROD\text{-}DC}$. Both $V_{ROD\text{-}RF}$ and $V_{VANE\text{-}AC}$ are applied at this time. One of the methods for applying $V_{VANE\text{-}AC}$ at this time is to use a combined wave with a shape of a noch (FNF) in which only the frequency corresponding to the m/z range of the ions for dissociation is missing, or to use scanning the frequency of $V_{VANE\text{-}AC}$ from the high-frequency side to the low frequency side (or the opposite direction), etc. In the latter case, it is necessary to exclude only the frequencies corresponding to the m/z range of the ions for dissociation in the scanning process. In both methods the ions with m/z other than that of the ions for dissociation are resonantly excited and oscillated, and are ejected out of the quadrupole linear ion trap 13. By these operations, only the ions for dissociation can be isolated in the quadrupole linear ion trap 13 in a stable state, since the ions are neither resonantly excited nor oscillated.

By repeating the operation of FIG. 9, in the quadrupole linear ion trap 13, new ions for dissociation can be isolated from dissociated and generated fragment ions, and can be dissociate further. That is, $MS^n$ analysis ($n \geqq 3$) can be performed.

After a dissociation process, the ions ejected from the quadrupole linear ion trap 13 pass the ion stop electrode 29, and mass spectrometry is performed on the ions in the TOF chamber 37 by the method explained in FIG. 2.

The embodiments 1 to 3 are performed with a combined configuration of an ion trap with a time-of-flight mass spectrometer ("TOFMS"), and the TOFMS is used as a mass spectrometry means.

Fourth Embodiment

A linear ion trap with multipole electrodes is employed as a mass spectrometry means in this embodiment.

Figure 10:
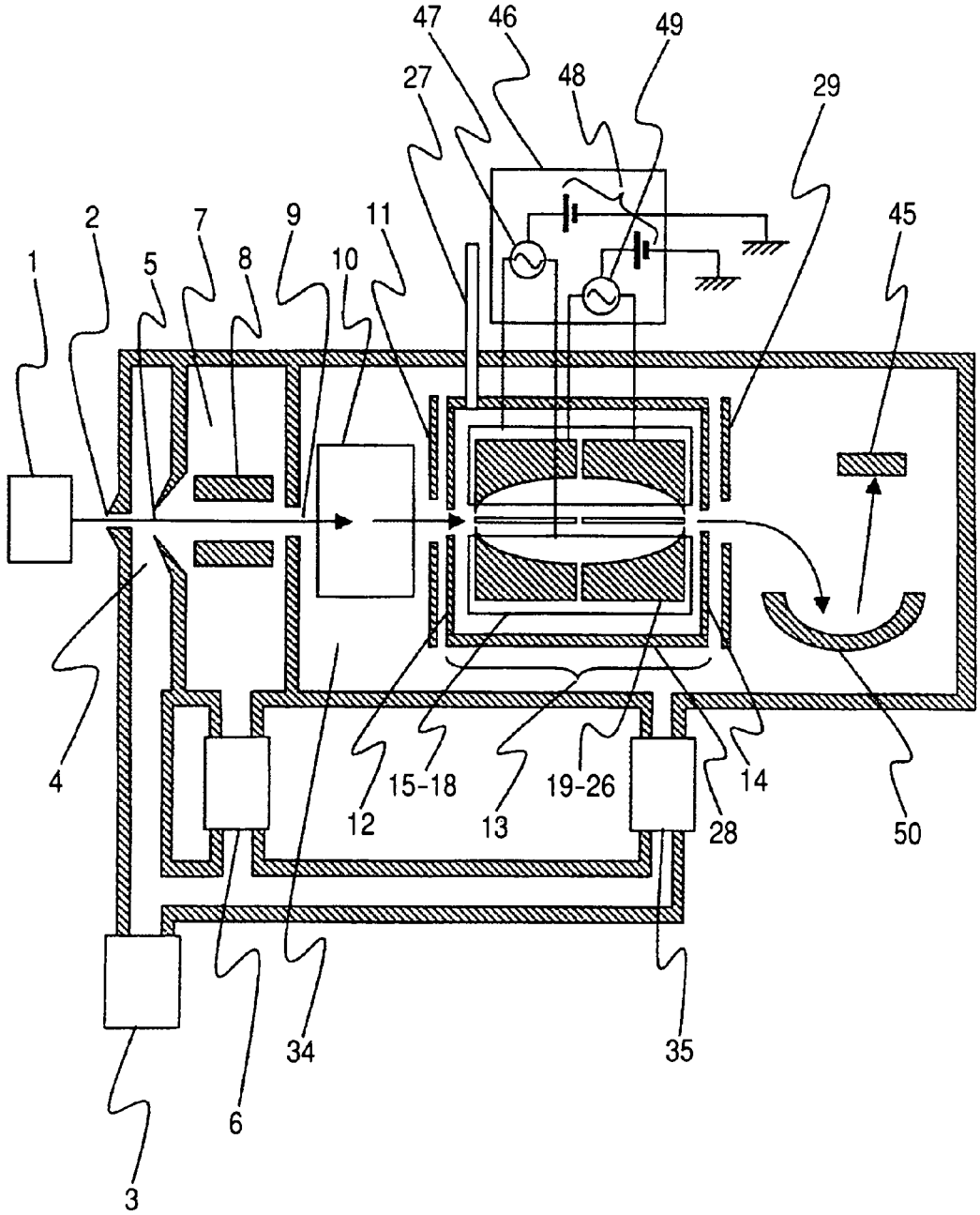
FIG. 10 is a schematic sectional view of the spectrometer used in the fourth embodiment of the present invention.

FIG. 10 is a schematic sectional view of the quadrupole linear ion trap mass spectrometer in accordance with the invention.

The ions generated in the ion source 1 pass through aperture 2, and are introduced to the first differential pumping region 4 evacuated to the 100-500 Pa with the rotary pump 3. After that, ions pass through aperture 5 and are introduced to the second differential pumping region 7 evacuated with the turbo molecular pump 6. The second differential pumping region 7, wherein multipole electrodes 8 are arranged, is maintained at pressures of about 0.3-3 Pa. A radio frequency wave with a frequency of about 1 MHz, and a voltage amplitude of several hundred volts, is applied to multipole electrodes 8 with a phase alternately reversed. Ions are converged in the vicinity of the central axis in the multipole electrodes 8 and transported with high efficiency.

The ions converged with the multipole electrodes 8 pass through aperture 9, and are introduced into an ion isolation unit 10 for the sample ions for dissociation. The ion isolation unit 10 for the sample ions for dissociation isolates only the ions for which detail analysis are to be performed, and do so by dissociation from all the ions generated in the ion source 1, and the analysis is performed using an ion trap system, a multipole mass filter, etc.

The ions isolated in the ion isolation unit 10 pass through a hole of a gate electrode 11 and an incap electrode 12, and are introduced into a quadrupole linear ion trap 13. The quadrupole linear ion trap 13 is constituted by an incap electrode 12, an endcap electrode 14, four rod electrodes 15-18, and eight sheets inserted electrodes 19-26 divided into an axial direction. Neutral gas, such as helium, is introduced into the quadrupole linear ion trap 13 through piping 27. The quadrupole linear ion trap 13 is constituted inside a case 28, and is held at pressures of about 0.01-1 Pa. In the quadrupole linear ion trap 13, accumulation and dissociation of the sample ions for dissociation are performed, and the ions are ejected out of the quadrupole linear ion trap 13 through the hole of the endcap electrode 14.

The ejected ions pass an ion stop electrode 29, collide with a conversion dynode 50, and are converted into an electron, and reach a detector 45 to be detected. The ion isolation unit 10 for sample ions for dissociation, the quadrupole linear ion trap 13, and conversion dynode 50 and detector 45 are arranged inside the vacuum chamber 34, which is evacuated with a turbo molecular pump 35, and is maintained at a vacuum of about $1\times10^{-3}$ Pa. The exhaust gas of the turbo molecular pump 6 and the turbo molecular pump 35 is exhausted with the rotary pump 3.

The voltage application method to the quadrupole linear ion trap 13 in the structure of FIG. 10 is basically the same as that of FIG. 3.

Figure 11:
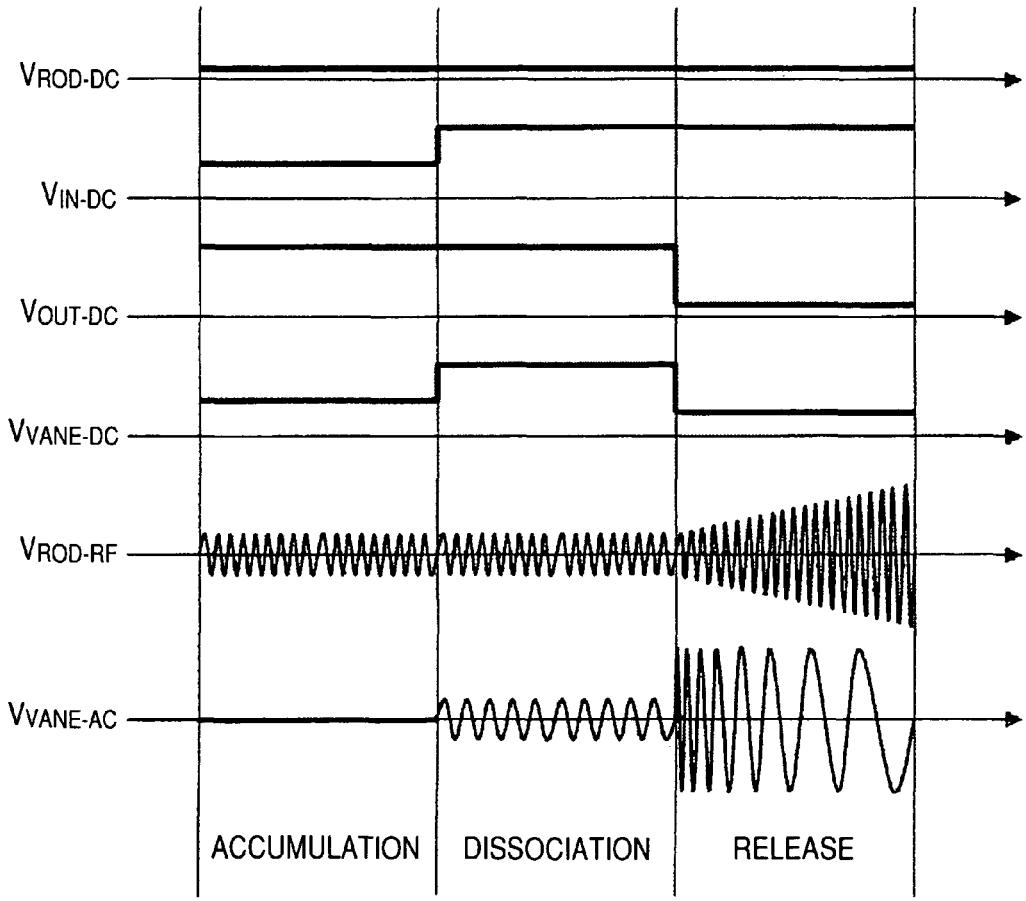
FIG. 11 is the operating sequence of the voltages applied to the electrodes shown in FIG. 10 for ion dissociation in the fourth embodiment of the invention.

Next, referring to FIG. 11, the operating sequence of each electrode is explained in the case of performing ion dissociation by the quadrupole linear ion trap 13. The operating-sequence diagram shown in FIG. 11 includes an accumulation and a dissociation process of the sample ions for dissociation, and an ion ejection process after the dissociation process. Since the operating sequence of accumulation, and dissociation processes is about the same as that of FIG. 4, an ejection process is explained in the following.

At the ion ejection process after dissociation operation, $V_{ROD\text{-}DC}$ is set to 10-20V, $V_{IN\text{-}DC}$ is set to a voltage higher than that of $V_{ROD\text{-}DC}$ by about a maximum of 30 V, $V_{OUT\text{-}DC}$ is set to a voltage lower than that of $V_{ROD\text{-}DC}$ by about a maximum of 5 V, and $V_{VANE\text{-}DC}$ is set to a voltage higher than that of $V_{ROD\text{-}DC}$ by about a maximum of 10 V. Under these conditions, the ions in the quadrupole linear ion trap 13 are ejected in order of their m/z by scanning the frequency of $V_{VANE\text{-}AC}$. At this time, the frequency of $V_{VANE\text{-}AC}$ is scanned from the high-frequency side to the low frequency side (or the opposite direction). A mass spectrum is obtained from the timing, the $V_{VANE\text{-}AC}$ frequency, and the strength of the signal, when the signal is detected with a detector 45. Moreover, although ejection efficiency can be improved by scanning the voltage amplitude of $V_{ROD-RF}$ in the ejection process, the voltage amplitude of $V_{ROD-RF}$ is not necessarily required to be scanned.

Fifth Embodiment

In this embodiment, a system is described in which the sample ions for dissociation are isolated in the linear ion trap with multipole electrodes in the structure of a quadrupole linear ion trap mass spectrometer, then the ions are resonantly excited and oscillated in the axial direction by a supplemental AC voltage and made to collide with a neutral gas molecule to dissociate.

In this embodiment, a system is explained in which ions are resonantly excited and oscillated in the radial direction with a supplemental AC voltage, and all the ions except the sample ions for dissociation are ejected out of a linear ion trap, and then the sample ions are dissociated.

Although the configuration of spectrometer in the present embodiment is nearly the same as that shown in FIG. 10, a sample ion isolation unit 10 is not necessarily required, since the sample ions for dissociation can be isolated in the quadrupole linear ion trap 13. The voltage applying method is basically the same as that of those shown in FIG. 7.

Figure 12:
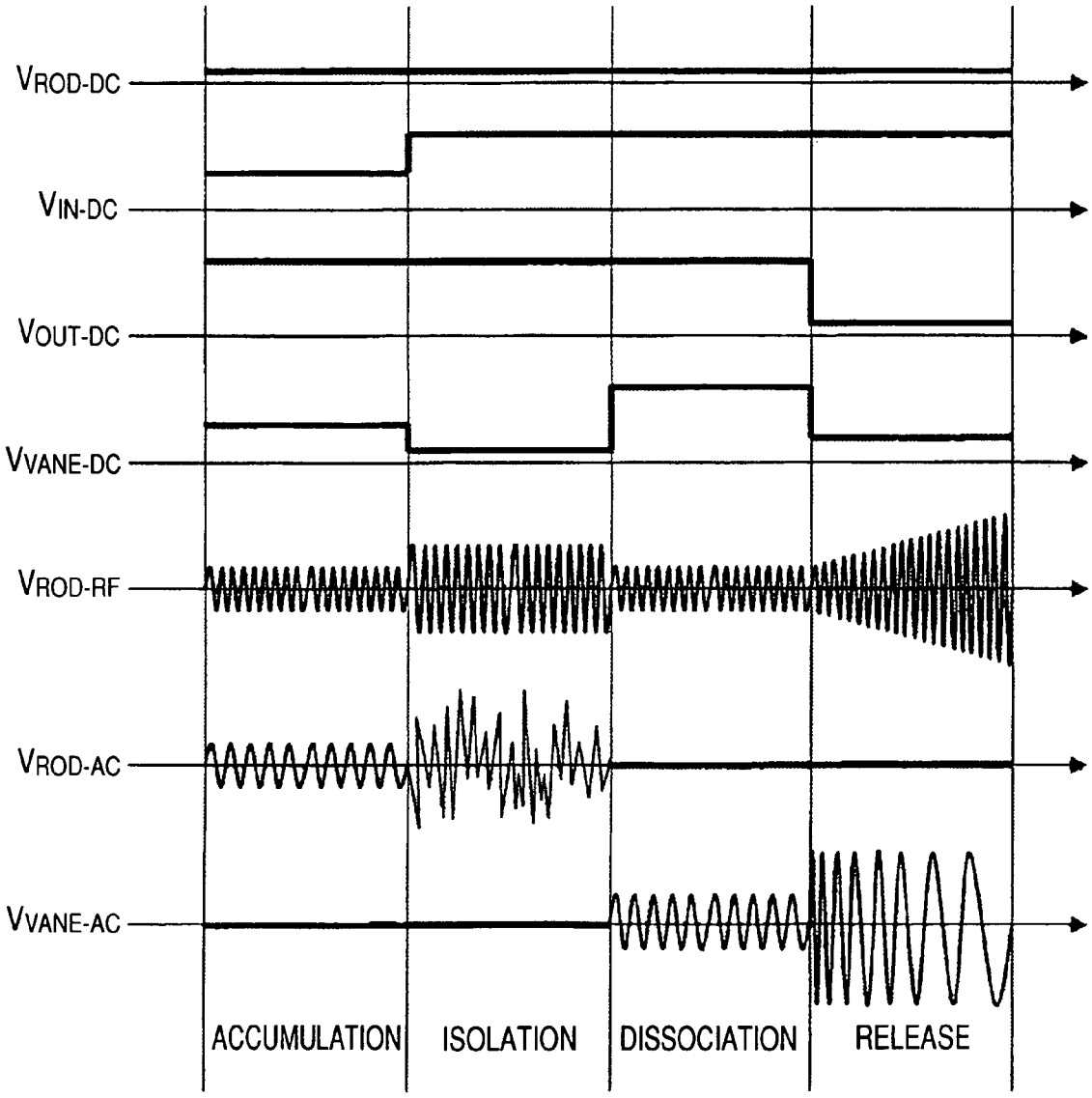
FIG. 12 is the operating sequence of the voltages applied to the electrodes similar to those shown in FIG. 10 for ion dissociation in the fifth embodiment of the invention.

Next, the operating sequence of each electrode in the case of performing isolation and dissociation of the ions for dissociation by the quadrupole linear ion trap 13 using FIG. 12 is explained. The operating-sequence of FIG. 12 consists of accumulation of ions, an ion isolation process for dissociation and a dissociation process, and an ion ejection process after dissociation operation. Since the operating sequence of accumulation, isolation, and dissociation processes is about the same as that of FIG. 8, the ejection process is explained in the following.

At the ion ejection process after dissociation operation, $V_{ROD-DC}$ is set to 10-20V, $V_{IN-DC}$ is set to a voltage higher than that of $V_{ROD-DC}$ by about a maximum of 30 V, $V_{OUT-DC}$ is set to a voltage lower than that of $V_{ROD-DC}$ by about a maximum of 5 V, and $V_{VANE-DC}$ is set to a voltage higher than that of $V_{ROD-DC}$ by about a maximum of 10 V. Under these conditions, the ions in the quadrupole linear ion trap 13 are ejected in order of their m/z by scanning the frequency of $V_{VANE-AC}$. At this time, the frequency of $V_{VANE-AC}$ is scanned from the high-frequency side to the low frequency side (or the opposite direction). A mass spectrum is obtained from the timing, the $V_{VANE-AC}$ frequency, and the strength of the signal, when the signal is detected with a detector 45. Moreover, although ejection efficiency can be improved by scanning the voltage amplitude of $V_{ROD-RF}$ in the ejection process, the voltage amplitude of $V_{ROD-RF}$ is not necessarily required to be scanned.

By repeating the operation of FIG. 12, in the quadrupole linear ion trap 13, new ions for dissociation can be isolated from dissociated and generated fragment ions, and can further be dissociated. That is, $MS^n$ analysis ($n \geqq 3$) can be performed.

Sixth Embodiment

In this embodiment, a system is described in which ions are resonantly excited and oscillated in the axial direction with an auxiliary alternating voltage, and all the ions except the sample ions for dissociation are ejected out of a linear ion trap, and then the sample ions are dissociated.

Although the configuration of spectrometer in the present embodiment is nearly the same as that shown in FIG. 10, a sample ion isolation unit 10 is not necessarily required since the sample ions for dissociation can be isolated in the quadrupole linear ion trap 13. The voltage applying method is basically the same as that of those shown in FIG. 3.

Figure 13:
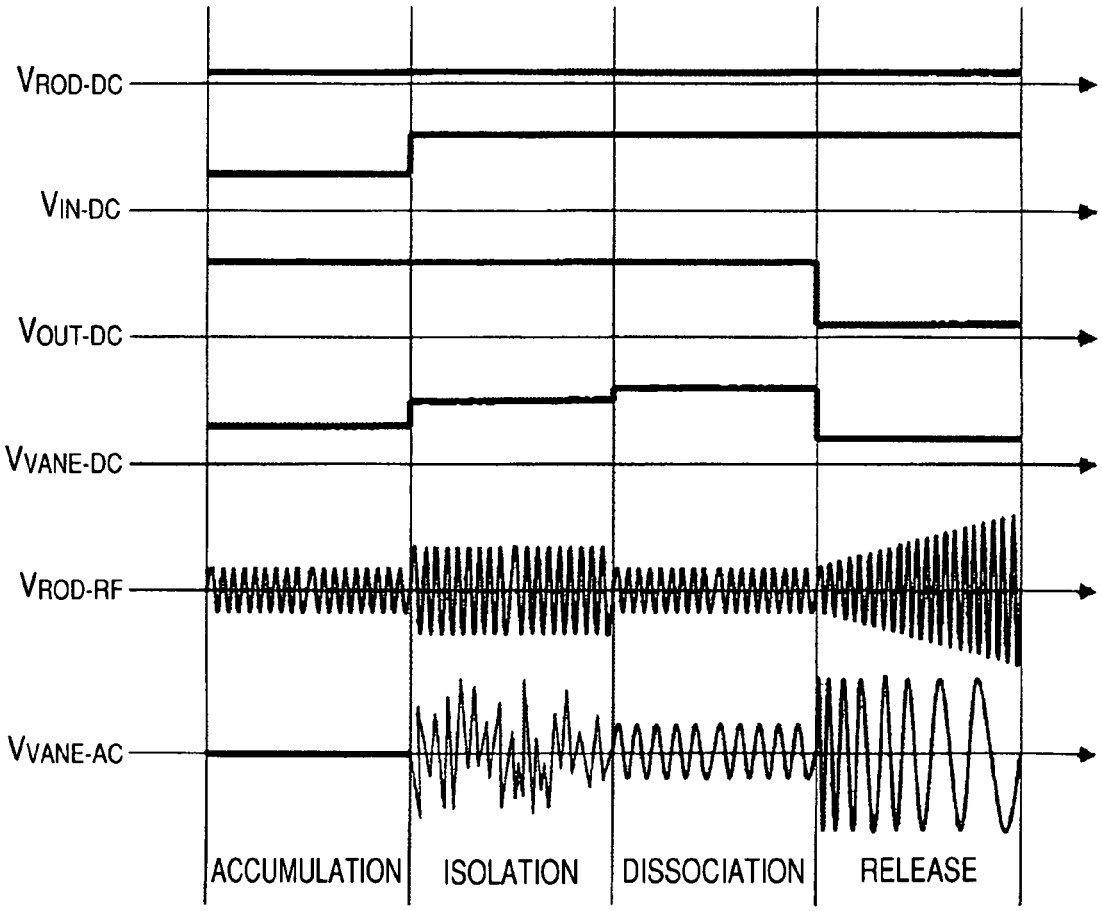
FIG. 13 is the operating sequence of the voltages applied to the electrodes similar to those shown in FIG. 10 for ion dissociation in the sixth embodiment of the invention.

Next, the operating sequence of each electrode in the case of performing isolation and dissociation of the ions for dissociation by the quadrupole linear ion trap 13 is explained using FIG. 13. The operating-sequence of FIG. 13 consists of an ion accumulation and isolation process for dissociation, a dissociation process, and an ion ejection process after the ion dissociation operation. Since the operating sequence of accumulation, isolation, and dissociation processes is about the same as that of FIG. 9, the ejection process is explained in the following.

At the ion ejection process after dissociation operation, $V_{ROD-DC}$ is set to 10-20V, $V_{IN-DC}$ is set to a voltage higher than that of $V_{ROD-DC}$ by about a maximum of 30 V, $V_{OUT-DC}$ is set to a voltage lower than that of $V_{ROD-DC}$ by about a maximum of 5 V, and $V_{VANE-DC}$ is set to a voltage higher than that of $V_{ROD-DC}$ by about a maximum of 10 V. Under the present circumstances, the ions in the quadrupole linear ion trap 13 are ejected in order of a m/z by scanning the frequency of $V_{VANE-AC}$. At this time, the frequency of $V_{VANE-AC}$ is scanned from the high-frequency side to the low frequency side (or the opposite direction). A mass spectrum is obtained from the timing, the $V_{VANE-AC}$ frequency, and the strength of the signal when the signal is detected with a detector 45. Moreover, although ejection efficiency can be improved by scanning the voltage amplitude of $V_{ROD-RF}$ in the ejection process, the voltage amplitude of $V_{ROD-RF}$ is not necessarily required to be scanned.

By repeating the operation of FIG. 13, in the quadrupole linear ion trap 13, new ions for dissociation can be isolated from dissociated and generated fragment ions, and can be dissociated further. That is, $MS^n$ analysis ($n \geqq 3$) can be performed.

Figure 14A:
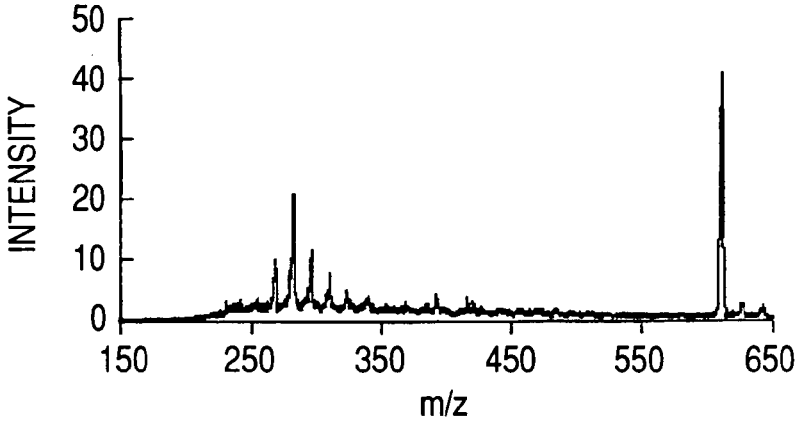
FIG. 14A shows a mass spectrum of all ions generated in the ion generation unit for reserpine.
Figure 14B:
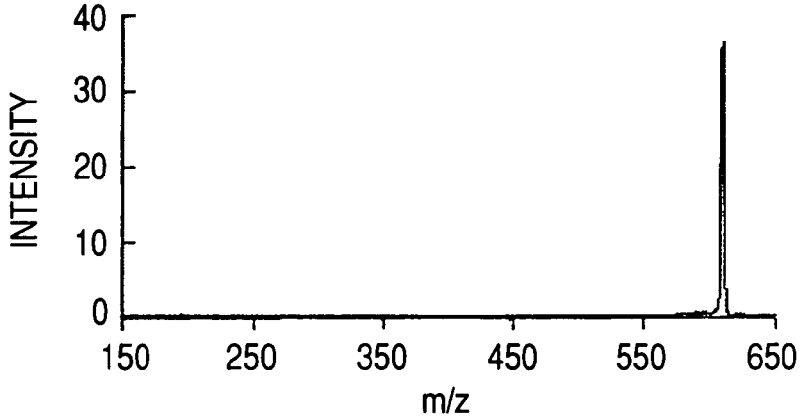
FIG. 14B shows a mass spectrum of the isolated sample ion (m/z 609.3)
Figure 14C:
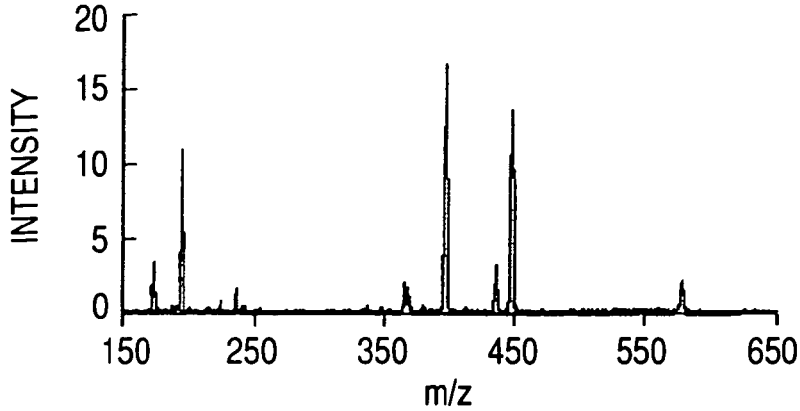
FIG. 14C shows a mass spectrum of the dissociated fragment ions obtained from the sample ions.

FIG. 14 shows a mass spectrum observed with the configuration of the sixth embodiment. The horizontal axis represents a m/z and the vertical axis a relative ionic strength, respectively. FIG. 14 shows the mass spectrum of reserpine as a sample, and FIG. 14A shows the total mass spectrum of all the ions generated in the ion source 1. FIG. 14B shows the spectrum of only the isolated sample ions for dissociation (m/z 609.3), and FIG. 14C shows the spectrum of the fragment ions obtained from dissociation of the sample ions for dissociation. From FIGS. 14A to 14C it is clearly shown that target fragment ions for dissociation can be isolated in the quadrupole linear ion trap 13 by resonantly excited oscillation in the axial direction by applying a supplemental AC voltage, and furthermore, the isolated sample ions for dissociation can also be dissociated by resonantly excited oscillation in the axial direction.

The present invention is effectively applied not only to the system of LIT-TOFMS in which the quadrupole linear ion trap ("LIT") described in the embodiments 1 to 3 combined with the TOFMS, and the system in which the quadrupole linear ion trap itself is employed as a mass spectrometry means, but also to that of LIT Fourier transform ion-cyclotron-resonance type mass spectrometer ("LIT-FT-ICRMS") in which the LIT is combined with the FT-ICRMS and the like.

Furthermore, the ion trap unit is also effective not only for a quadrupole linear ion trap structure but also for a Hexapole or an Octapole linear ion trap structure, and the like, and also for a non-linear ion trap structure.

What is claimed is:

1. A mass spectrometer comprising:

an ion source for generating ions;

a linear ion trap having multiple rod electrodes for at least two of storing, mass-selectively isolating, mass-selectively dissociating, and mass-selectively removing ions;

electric-field forming electrodes for forming an electric field along an axial direction of the linear ion trap, wherein the electric field is an electrostatic potential;

a power supply unit for controlling operation of the linear ion trap; and a detector for detecting ions ejected from the linear ion trap, wherein said electric-field forming electrodes are inserted between adjacent rod electrodes of said multiple rode electrodes and the power supply unit includes a first supplemental AC power supply unit applying a supplemental AC voltage to the rod electrodes and a second supplemental AC power supply unit applying a supplemental AC voltage to the electric field forming electrodes, wherein upon application of the supplemental AC voltage to the rod electrodes by the first supplemental AC power supply unit, ions in the linear ion trap are oscillated in a radial direction of the linear ion trap via resonance excitation, and thereby ions having a mass/charge ratio within a first predetermined range are mass-selectively isolated, and wherein upon application of the supplemental AC voltage to the electric field forming electrodes by the second supplemental AC power supply unit, ions in the linear ion trap are oscillated in the axial direction of the linear ion trap by resonance excitation, and thereby ions in the linear ion trap having a mass/charge ratio within a second predetermined range are mass-selectively dissociated.

2. The mass spectrometer according to claim 1, wherein the electric field forming electrodes are inserted electrodes being divided into two or more in the axial direction of the linear ion trap.

3. The mass spectrometer according to claim 1, wherein the electrostatic potential has a depth higher than or equal to 5 V.

4. The mass spectrometer according to claim 1, further comprising an ion isolation unit for isolating ions generated from the ion source, the ion isolation unit being arranged between the ion source and the linear ion trap.

5. The mass spectrometer according to claim 1, wherein the ions in the linear ion trap are ejected by scanning a frequency of the supplemental AC voltage applied by the second supplemental AC power supply unit.

* * * * *